United States Patent [19]

Millet

[11] Patent Number: 4,613,014

[45] **Date of Patent: * Sep. 23, 1986**

[54] OIL CHANGING AND LUBRICATING APPARATUS

[76] Inventor: Serge D. Millet, 40 Rongail St., Nepean, Ontario, K2G 0K4

[ * ] Notice: The portion of the term of this patent subsequent to Apr. 2, 2002 has been disclaimed.

[21] Appl. No.: 717,032

[22] Filed: Mar. 28, 1985

Related U.S. Application Data

[63] Continuation-in-part of Ser. No. 500,459, Jun. 2, 1983, Pat. No. 4,508,195.

[51] Int. Cl.[4] ..... F01M 11/04; F16N 25/00

[52] U.S. Cl. ..... 184/1.5; 184/7.2; 184/105.1; 123/196 R; 417/343; 418/154

[58] Field of Search ..... 418/154, 181; 417/313; 184/1.5, 7.2, 7.3, 105; 123/196 R, 196 A, 196 AB, 196 S, 198 C

[56] References Cited

U.S. PATENT DOCUMENTS

| | | | |
|---|---|---|---|
| 2,834,376 | 5/1958 | Hughes | 184/7.2 X |
| 3,059,583 | 10/1962 | Huber | 418/154 X |
| 3,829,248 | 8/1974 | Bright et al. | 418/154 X |
| 4,508,195 | 4/1985 | Millet | 418/154 X |

*Primary Examiner*—Leonard E. Smith

*Attorney, Agent, or Firm*—Dennison, Meserole, Pollack & Scheiner

[57] ABSTRACT

There is disclosed an oil changing and lubricating system for a vehicle comprising a housing connectable to the vehicle, a pump affixed to the housing, the intake of the pump communicating with an oil reservoir for the vehicle and the outlet of the pump being adapted for communication with a receptacle for oil removed from the reservoir when the pump is in use and lubricant inputs mounted on the housing for connection to a supply of lubricant, the inputs communicating with the points of the vehicle requiring lubrication for the delivery of lubricant thereto.

11 Claims, 7 Drawing Figures

OIL CHANGING AND LUBRICATING APPARATUS

CROSS-REFERENCE TO RELATED APPLICATION

This application is a continuation-in-part of application Ser. No. 500,459, filed June 2, 1983, in the name of Serge D. Millet, now U.S. Pat. No. 4,508,195.

BACKGROUND OF THE INVENTION

The present invention relates to an attachment to a motor vehicle and more specifically to an apparatus for facilitating oil changes and chassis lubrication.

When changing the oil and lubricating the chassis of a vehicle, it is of course necessary to access the underside of the vehicle to remove the oil plug from the sump for drainage purposes and to gain access to the grease nipples provided at various points on the chassis for lubricating bearings, joints and so forth. Particularly for those who prefer to do their own oil changes, this can prove awkward if not extremely difficult as well as dirty. There is as well an element of danger if a vehicle is improperly lifted for the purpose of gaining access to the underside. Improper supports have been known to collapse with serious consequences to any one caught beneath the vehicle.

To overcome these difficulties, it has been found advantageous to provide a remote device which communicates with the oil sump and the points of the vehicle requiring lubrication which permits oil changes and chassis lubrications without the necessity of actually accessing the underside of the vehicle.

SUMMARY OF THE INVENTION

Accordingly, it is an object of the present invention to at least partially overcome the disadvantages of the prior art by providing an oil changing and lubricating apparatus which is particularly suitable for changing engine oil and lubricating a vehicle chassis.

A further object of the present invention is to provide a device which eliminates the need to work beneath a vehicle when changing its oil or lubricating its chassis.

A still further object of the present invention is to provide an oil changing and lubricating device which is relatively inexpensive to manufacture and which is easy and safe to use.

In a preferred embodiment, the apparatus described herein comprises a housing which may be located in the engine compartment of the vehicle in a position where it is readily and conveniently accessible. The housing includes a pump, the intake of which communicates with the oil sump and the outlet of which includes a hose which may be led to a waste oil receptacle when the pump is actuated to drain the sump. Mounted on the housing are a plurality of grease nipples each of which communicate by means of a flexible, high pressure hose with the points of the chassis requiring lubrication. Oil changes and chassis lubrications may therefore be easily and readily performed without accessing the underside of the vehicle and in a much more convenient and safe manner than was previously possible.

According to the present invention, then, there is provided an oil changing and lubricating system for a vehicle comprising a housing connectable to the vehicle, pump means affixed to the housing, the intake of the pump means communicating with an oil reservoir for the vehicle and the outlet of the pump means being adapted for communication with a receptacle for oil removed from the reservoir when the pump means is in use, and lubricant input means mounted on the housing for connection to a supply of lubricant, the input means communicating with the point of the vehicle requiring lubrication for the delivery of lubricant thereto.

According to the present invention, then, there is also provided an oil draining and lubricating system adapted for connection as an accessory to a vehicle having an engine with an oil reservoir and an oil reservoir drain opening and points on the vehicle requiring lubrication, the system comprising, impeller means and an axially extending spindle connected thereto, a rigid housing including a cavity formed therein to receive the impeller, the impeller and cavity cooperating to define therebetween a pump for draining oil from the reservoir, the pump being actuated by rotation of the spindle, an inlet and an outlet port each opening through the housing into the cavity for fluid communication therewith, an outer portion having a plurality of apertures formed therein, cover means to seal the cavity, and guide means having an aperture through which the spindle rotatably extends in fluid-tight relationship, buting means connected at one end thereof to the intake port and at the other end thereof to the oil reservoir, a flexible hose leading from the outlet port for disposing of oil drained from the oil reservoir, grease fittings provided in each of the apertures formed in the outer portion of the housing, and a high pressure flexible tube leading from each of the grease fittings for connection to respective ones of the points on the vehicle requiring lubrication to permit the delivery of lubricant thereto.

BRIEF DESCRIPTION OF THE DRAWINGS

The present invention will now be described in greater detail and will be better understood when read in conjunction with the following drawings in which.

DETAILED DESCRIPTION

The present oil changing and lubricating apparatus described hereinafter for the purpose of illustrating an exemplary embodiment thereof is described in the context of and for use in association with a motorized vehicle such as an automobile. It will be appreciated that the present apparatus may find use with virtually any machinery utilizing an internal combustion engine or that requires periodic lubrication of its various components and sub-assemblies.

Figure 1:
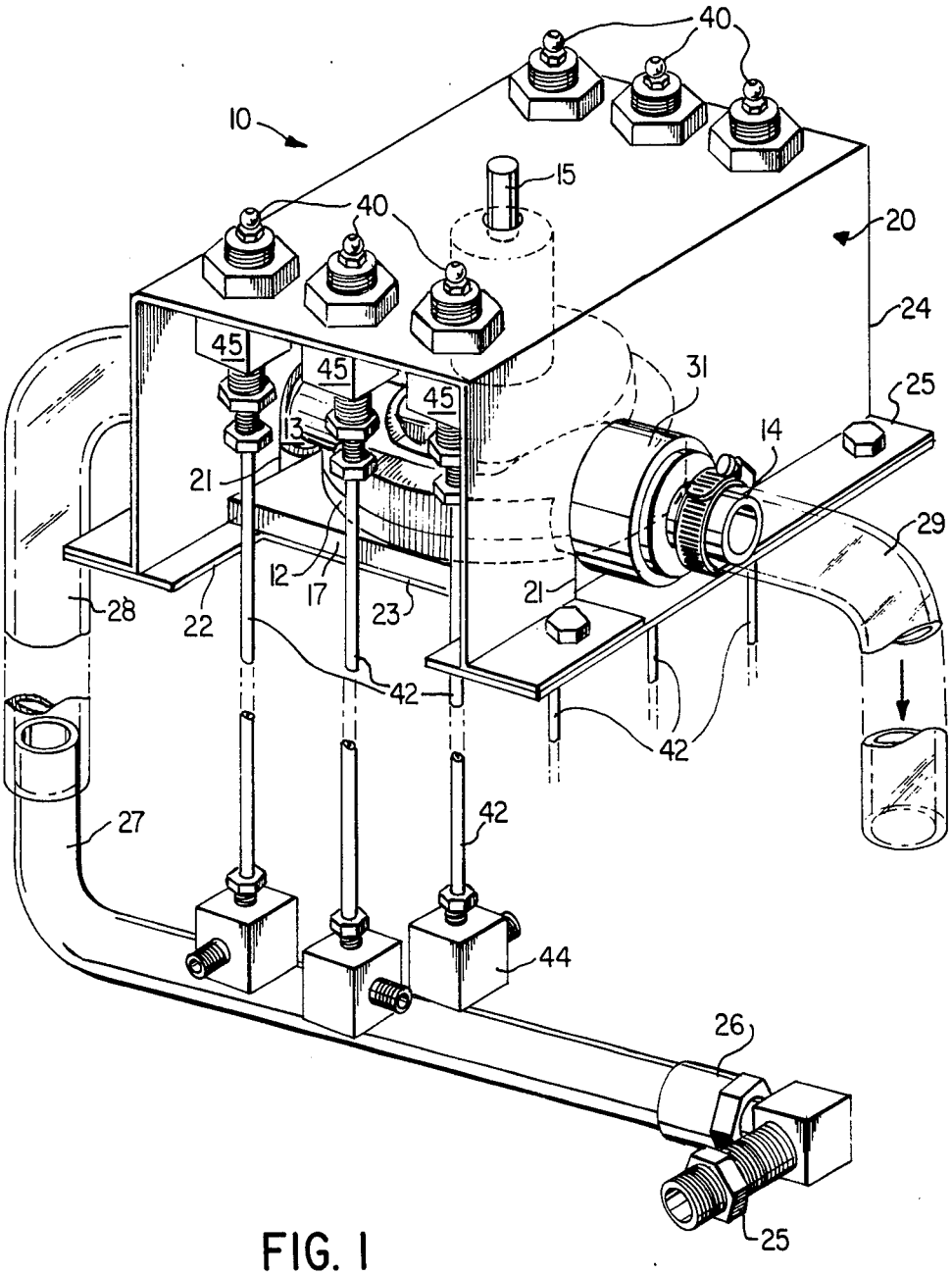
FIG. 1 is a perspective view of the present apparatus as will be described in greater detail hereinafter.
Figure 2:
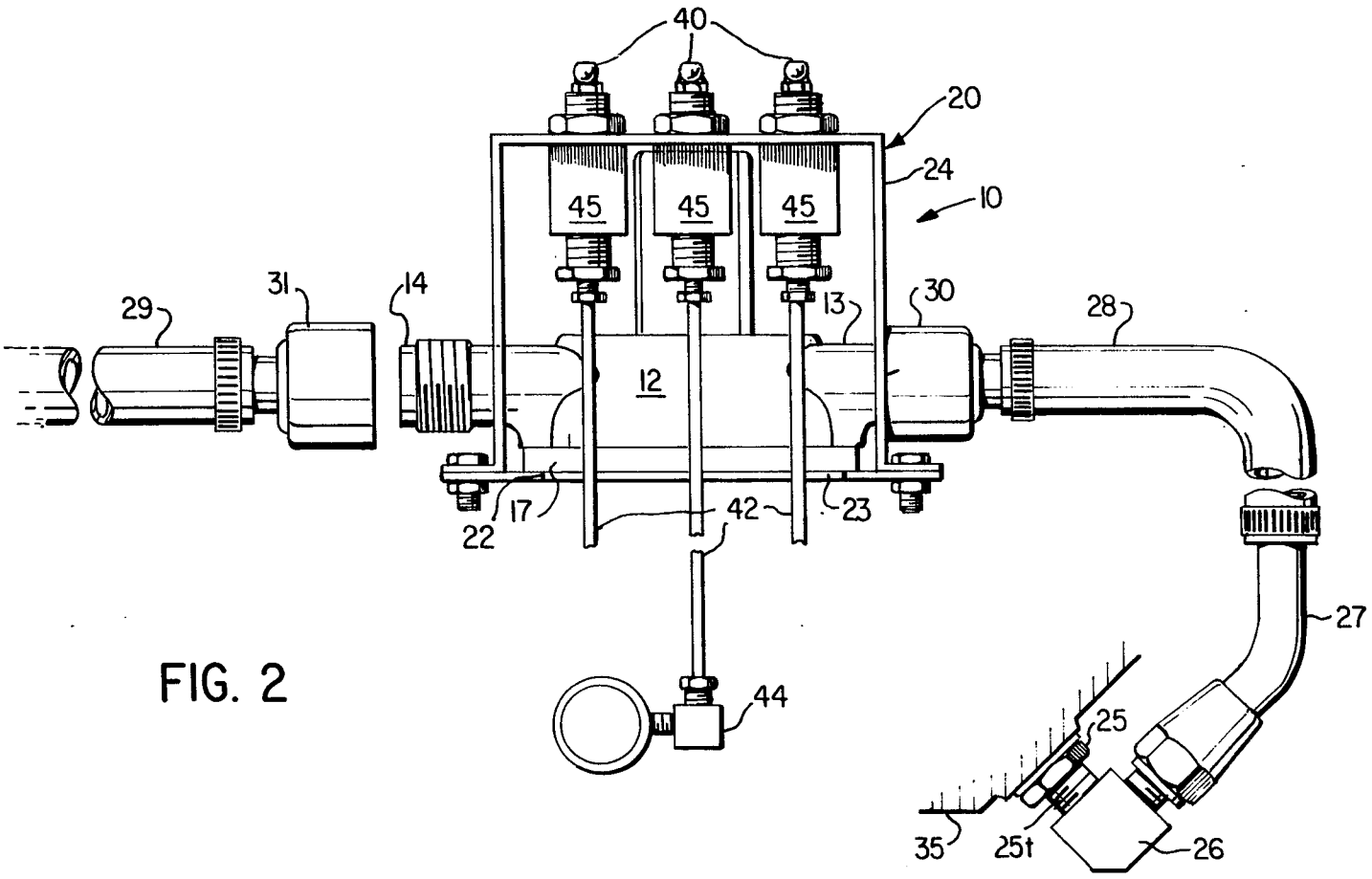
FIG. 2 is a side elevational view of the apparatus of FIG. 1.

With reference now to FIGS. 1 and 2, the present apparatus, indicated generally as at 10, includes an impeller type pump 12 mounted within a housing 20 to have an inlet or intake end of the pump 13 extending outwardly from one side of the housing through an aperture 21 formed therein and an outlet 14 extending outwardly from the opposite side of the housing through a similar aperture.

The intake side of the pump is placed in fluid communication with the vehicle's oil reservoir in a manner to be described below for drawing oil from the reservoir when the pump is activated. The oil pumped from the reservoir is discharged to a waste oil receptacle as will also be described below via the pump's outlet or discharge end 14.

Housing 20 itself comprises a cowling 24 having flanges 25 formed along its lower edges to facilitate its connection by means of screws or other fasteners to a base plate 23. Pump 12 within the housing is supported by one or two resilient pads 17 such as of rubber and the apertures 21 formed into opposite sides of the housing are so dimensioned that the pump is firmly pressed against the pads 17 when cowling 24 is fastened to base plate 23 to secure the pump in place without the need for additional fasteners.

The intake side 13 of pump 12 is connected via tubing means for fluid communication with an oil reservoir 35 of the vehicle, the reservoir typically being the oil sump or pan located at the undermost side of the vehicle's engine. A flexible piece of tubing 28 is clamped or otherwise connected at one end thereof to a threaded connector 30 which mates with the threads formed on intake 13 to provide a fluid tight connection. The other end of tubing 28 is clamped to a length of metal tubing 27, which may be fabricated of copper, having a 90° adaptor 26 provided at the end thereof adjacent sump 35. Adaptor 26 is connected to a threaded bushing 25 which is externally threaded as at 25t to threadedly engage an aperture such as the drain hole normally formed in an oil pan to receive an oil plug. Bushing 25 is of course hollow to complete the fluid connection between pump 12 and the oil sump.

Flexible tubing 28 may extend to connect directly with bushing 25 although the use of rigid tubing 27 prevents sagging of the tubing below the vehicle and also provides greater puncture and hazard resistance.

Pump outlet 14 is similarly threaded for engagement to connector 31 which may be identical to connector 30. A length of flexible hose 29 is clamped to connector 31. When not in use, hose 29 may be tucked aside in an out-of-the-way position or the tubing together with connector 31 may be detached from the pump and simply stored away.

When it is desired to drain reservoir 35 for the purpose of changing the engine's oil, hose 29 may be directed to any suitable waste oil receptacle and pump 12 is activated to transfer the contents of the sump to the receptacle. The draining is accomplished in a matter of seconds without the need to access the underside of the vehicle to remove the oil plug.

Pump 12 may include its own prime mover operable from the vehicle's battery or the like, but from a weight and cost point of view, it has been found advantageous to employ a "drill" pump, that is, a pump externally actuatable by rotary means such as a handheld electric drill.

A drill pump, such as pump 12 shown in the drawings hereto, includes an outwardly projecting rotatable spindle 15 connected to the pump's impeller. The pump is mounted within housing 20 so that spindle 15 projects through an aperture formed into the upper surface of cowling 24. The spindle is thereby accessible for grasping by rotary means such as the chuck of a handheld electric drill to thereby activate pump 12.

A drill pump suitable for use with the present apparatus is produced by the Dynaco Corporation under the trade mark LITTLE GIANT.

In addition to changing a vehicle's oil, chassis lubrication is also an important aspect of vehicle maintenance. A vehicle may have a number of lubrication points. Grease nipples are typically provided adjacent each such point to which a grease gun may be attached for the purpose of introducing lubricant to the lubrication point which may be a ball joint, bearing, rod end or the like. As mentioned above, access to the grease nipples is usually from the underside of the vehicle with the attendant disadvantages discussed above.

To overcome this problem, it has been found advantageous to provide the grease nipples themselves on housing 20, interconnecting the nipples with the lubrication points by means of high pressure flexible tubing.

With reference once again to FIGS. 1 and 2, a plurality of lubricant input means such as grease nipples 40 are arranged on cowling 24 adjacent the ends thereof, the number of such nipples corresponding generally to the number of lubrication points on the vehicle. Flexible tubing such as high pressure nylon hoses 42 lead from each nipple 40 to a lubrication point and are connected to the lubrication point by means of 90° adaptors 44. To this end, existing nipples may be removed and the adaptors are threadedly inserted in their place.

To provide clearance for hoses 42 as they leave nipples 40, base plate 23 is recessed as at 22. If more nipples are required, the length of housing 20 may be extended to accommodate, for instance, two rows of nipples at each end thereof.

Figure 3:
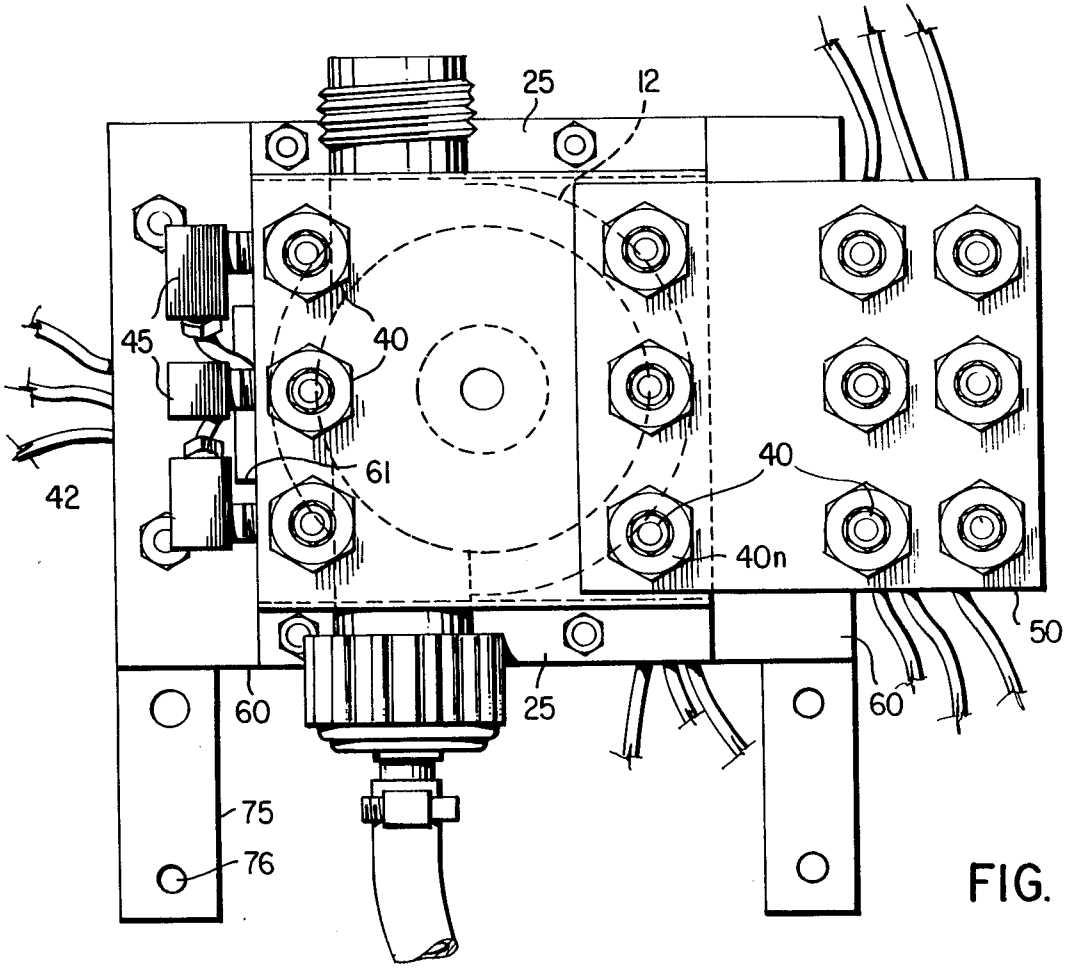
FIG. 3 is a plan view of a further embodiment of the present apparatus.

Alternatively, the extra nipples may be affixed to an add-on plate 50 such as is shown in FIG. 3 illustrating another embodiment of the present apparatus. As will be seen from FIG. 3, plate 50 is formed having, for instance, three apertures (not shown) formed adjacent one edge thereof which fit over grease nipples 40 so that the plate may be connected to the housing by means of the same nuts 40*n* which fasten nipples 40 to cowling 24. Additional grease nipples 40 are mounted onto plate 50 as required.

In FIG. 3, like elements have been referenced by like reference numerals to those used in describing the embodiment of FIGS. 1 and 2. In the embodiment illustrated in FIG. 3, rectangular plates 60 straddle the open ends of housing 20 and are connected to flanges 25. Plates 60 are formed with a recess 61 to define an opening between plate 60 and base plate 23 through which flexible hoses 42 are led. Hoses 42 are connected to grease nipples 40 by means of 90° adaptors 45 rather than directly to the nipples as shown in FIGS. 1 and 2.

It is of course preferable to mount apparatus 10 to the vehicle at a point where it will be readily accessible. It has been found advantageous to mount the apparatus within the vehicle's engine compartment at any suitable location whereby spindle 15 and grease nipples 40 are immediately accessible upon opening of the vehicle's hood. Any suitable bracket such as brackets 75 may be used to mount apparatus 10 within the engine compartment of the vehicle and apertures 76 are provided in brackets 75 for this purpose.

As will be appreciated, the above-described apparatus includes both a pump having its own housing and a separate outer housing 20 which supports the pump, the grease nipples and the remaining components of the apparatus. Significant economies of manufacture can be achieved by integrating the pump and outer housings into a unitary integral structure. Such a structure will now be described with reference to FIGS. 4 to 6 wherein like reference numerals are used wherever possible to designate elements corresponding to those appearing in FIGS. 1 to 3.

Figure 5:
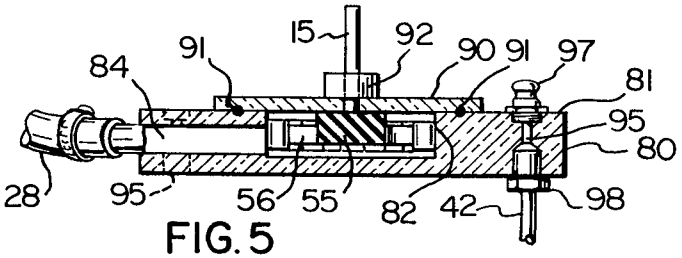
FIG. 5 is a cross-sectional view of the apparatus of FIG. 4 along the line II—II.
Figure 6:
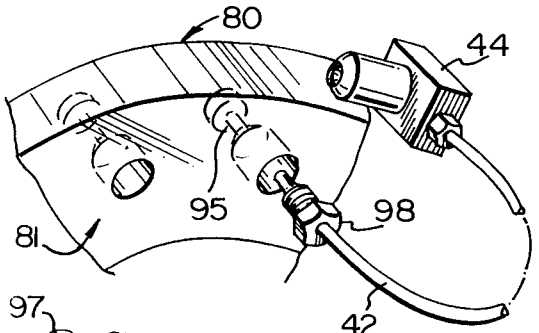
FIG. 6 is a perspective, partially cutaway and partially exploded view of a portion of the embodiment of FIG. 4.
Figure 4:
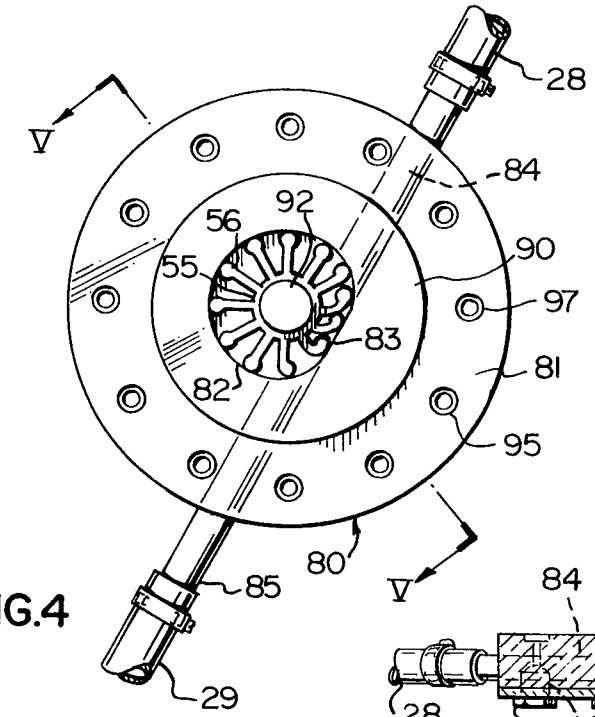
FIG. 4 is a plan view of yet another embodiment of the present apparatus.

With reference to FIGS. 4 and 5, the housing, identified by reference numeral 80, is seen to consist of a single rigid piece of material, either metal or plastic, plastic being preferred for cost and manufacturing reasons. Formed into the housing is a generally cyclindrically-shaped cavity 82 with a slight flattening at a portion of its periphery as shown at 83. Opening into the cavity at one extremity of flattening 83 is an intake port 84 which extends through the housing for connection to oil reservoir 35 (not shown) by means of flexible tube 28 and metal tube 27 shown in FIG. 2 (An alternative means of connecting the intake with the oil reservoir is to replace tubes 28 and 27 with a single length of flexible hose which can be inserted through the tube provided for the dipstick into the oil pan). Extending through the housing from the opposite extremity of flattening 83 is an outlet port 85 which connects at its outer end to flexible hose 29 for disposal of the waste oil. Simple hose clamps 50 may be used to connect ports 84 and 85 to hoses 28 and 29, respectively.

Housing 80, cavity 82 and ports 84 and 85 are preferably injected moulded as an integral unit.

To actually form a pump, given the peripheral shape of cavity 82 and the provision of ports 84 and 85, it is necessary merely to insert a suitable rotatable impeller into the cavity. Such an impeller is designated by reference numeral 55 and is formed to include a plurality of resiliently deformable impeller blades 56 which engage the outer periphery of the cavity and are flexured even further by engagement with flattening 83, thereby inducing suction at the opening into port 84 and pressure at the outlet into port 85. The shape and construction of the cavity and impeller and the manner in which they cooperate to induce a pumping action are well known in the pumping art and need not be described in further detail herein. As will be appreciated, other cavity and impeller shapes which co-operate to form a pump of the self-priming sort may be used with equal effect.

Impeller 55 includes an axially extending spindle 15 connected thereto for the purposes described above. More specifically, an electric drill or any other suitable rotary tool can be used to grip and rotate the spindle and the connected impeller to cause the required pumping action to remove oil from the engine sump.

If preferred, a small electric motor operated from the vehicle's battery can be fitted over the spindle to drive the same and actuate the pump. The motor can be screwed onto the housing to be securely connected thereto and a switch provided to turn the motor on or off as required to drain the oil. If such a pump motor is provided, housing 80 can be turned over so that spindle 15 extends downwardly and so that the motor is positioned beneath the unit in an out of the way location. The relative positions of the grease nipples and compression nuts will be reversed of course so that the grease nipples continue to be located on the upwardly disposed surface of the unit for easy access.

A removable cover 90 is provided to close the cavity in cooperation with a suitable seal such as an O-ring 91 or flexible gasket. The cover may be held in place by screws, clips or any other suitable fasteners and may in fact be permanently connected to the housing, although this is not altogether desirable in that it is possible for the pump to clog or its parts to wear, necessitating access for replacement or repair.

Cover 90 includes guide means such as cap 92 having a bushed aperture 93 formed therethrough and as will be obvious, spindle 15 is rotatably received and guided through the aperture in fluid-tight relationship to extend above the housing for convenient connection to the drill.

As will be seen, housing 80 is enlarged substantially beyond that required to accommodate cavity 82 and includes an outer portion identified by reference numeral 81. Given the cylindrical disc shape of the illustrated embodiment, outer portion 81 extends annularly about cavity 82 and lid 90, although as other housing shapes are contemplated, outer portion 81 may occur wherever convenient space is provided. A plurality of apertures 95 are formed through outer portion 81, each aperture being enlarged at its opposite ends as shown most clearly in FIG. 6.

Each aperture is adapted to securely receive suitable grease fittings such as a grease nipple 97 securely fitted into the upper enlargement and a compression nut 98, for gripping flexible tubing 42, screwed into the lower enlargement. As with the previously described embodiment, the number of apertures, and grease fittings, corresponds generally to the number of lubrication points on the vehicle chassis. The flexible tubing 42 leads of course from the grease fittings to the vehicle lubrication points and is connected thereto by means of suitable adaptors 44.

The housing may be mounted to the vehicle in any suitable fashion. By way of example only, a cylindrical bracket 101 having a circumferential groove 102 may be formed or attached to the bottom of housing 80. A cooperating forkshaped bracket 104 having tynes 105 which enter and engage groove 102 is attached to the vehicle at any convenient and accessible location and the housing is attached thereto by sliding bracket 101 between the tynes. Other means of mounting the apparatus to the vehicle will be readily apparent to those skilled in the art and the above description is therefore merely exemplary in nature.

The operation of this embodiment is substantially identical to the operation of the embodiments described above.

Figure 7:
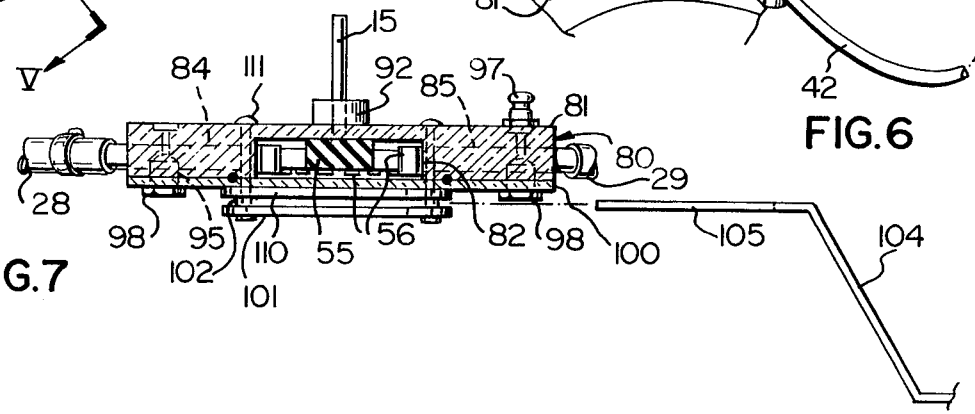
FIG. 7 is a cross-sectional view of a slightly modified version of the apparatus of FIG. 4 along the line II—II.

With reference to FIG. 7 there is shown a cross-sectional view of a slightly modified version of this embodiment. To simplify the construction of the housing even further, cavity 82 is formed to open through the lower surface of the housing to extend towards the upper surface thereof. Spindle 15 continues to project upwardly through bushed cap 92, which now is formed integrally with the rest of the housing, but in place of cover 90, a cover 100, in the form of a correspondingly shaped plate, is secured to the housing to form the lower surface thereof and to seal cavity 82 in cooperation with 0. ring 91 or other suitable gasket means. Compression nuts 98 may be used to secure lid 92 in place or separate fasteners may be used for this purpose.

To connect the unit to the vehicle, the housing can be secured to a simple bracket 110 as shown by means of machine screws 111 passing through the body of the housing to engage the bracket.

While the invention has been described in terms of several particularly useful embodiments, it will be understood that various equivalents may be used without departing from the scope of this invention as defined by the following claims.

I claim:

1. A housing for an oil changing and lubricating system for a vehicle, said housing cooperating with impeller means to define therewith a pump, said housing comprising:

(a) a cavity formed therein to receive said impeller means, said cavity being adapted to cooperate with said impeller means to induce a pumping action upon rotation of said impeller means;

(b) an inlet and outlet port each opening through said housing into said cavity for fluid communication therewith;

(c) an outer portion having a plurality of apertures formed therethrough, each of said apertures being adapted to fixedly receive grease fittings therein; and (d) cover means to cover and seal said cavity when said impeller means are disposed therein.

2. An oil draining and lubricating system adapted for connection as an accessory to a vehicle having an engine with an oil reservoir and an oil reservoir drain opening and points on said vehicle requiring lubrication, said system comprising:

impeller means and an axially extending spindle connected thereto;

a rigid housing including:

(a) a cavity formed therein to receive said impeller, said impeller and cavity cooperating to define therebetween a pump for draining oil from said reservoir, said pump being actuated by rotation of said spindle;

(b) an inlet and an outlet port each opening through said housing into said cavity for fluid communication therewith;

(c) an outer portion having a plurality of apertures formed therein;

(d) cover means to seal said cavity; and (e) guide means having an aperture through which said spindle rotatably extends in fluid-tight relationship;

tubing means connected at one end thereof to said intake port and at the other end thereof to said oil reservoir;

a flexible hose leading from said outlet port for disposing of oil drained from said oil reservoir;

grease fittings provided in each of said apertures formed in the outer portion of said housing; and a high pressure flexible tube leading from each of said grease fittings for connection to respective ones of said points on said vehicle requiring lubrication to permit the delivery of lubricant thereto.

3. The system of claim 2 wherein each of said apertures is adapted at one end thereof to receive a grease nipple therein and at the other end for compression nut means to which is connected said high pressure flexible tube.

4. The system of claim 3 wherein said housing is shaped as a cylindrical disc having an upper and lower surface, said cavity being formed in said upper surface at substantially the center thereof to extend partially through said disc towards said lower surface.

5. The system of claim 4 wherein said cover means are secured to said upper surface of said housing to seal said cavity in cooperation with gasket means, said guide means being formed on said cover means to permit said spindle means to extend therethrough.

6. The system of claim 5 wherein said plurality of apertures formed in said outer portion are disposed annular about said cavity.

7. The system of claim 3 wherein said housing is shaped as a cylindrical disc having an upper and lower surface, said cavity being formed in said lower surface at substantially the center thereof to extend partially through said disc towards said upper surface.

8. The system of claim 7 wherein said cover means are secured to said lower surface of the disc to seal said cavity in cooperation with gasket means.

9. The system of claim 8 wherein said guide means are formed on said upper surface of said housing, whereby said spindle extends through said upper surface and said aperture in said guide means.

10. The system of claim 9 wherein said cover means is secured to said lower surface by means of said compression nut means.

11. They system of claim 10 further including motor means to engage and rotate said spindle and said impeller means connected thereto.

* * * * *